US006922122B2

(12) United States Patent
Saruwatari et al.

(10) Patent No.: US 6,922,122 B2
(45) Date of Patent: Jul. 26, 2005

(54) ELECTROMAGNETIC RELAY

(75) Inventors: Yojiro Saruwatari, Kumamoto (JP); Keisuke Yano, Kumamoto-ken (JP); Shinichi Furusyo, Kumamoto (JP); Tetsuya Fujiwara, Kumamoto (JP); Ryota Minowa, Yamaga (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/829,684

(22) Filed: Apr. 22, 2004

(65) Prior Publication Data

US 2004/0263293 A1 Dec. 30, 2004

(30) Foreign Application Priority Data

Apr. 24, 2003 (JP) ..... P2003-120308

(51) Int. Cl.[7] ..... H01H 9/02; H01H 13/04

(52) U.S. Cl. ..... 335/202; 335/78; 335/86; 335/113; 335/186; 335/238

(58) Field of Search ..... 335/78–86, 113, 335/132, 157, 167, 168, 186, 202, 238; 200/295

(56) References Cited

U.S. PATENT DOCUMENTS 5,194,839 A * 3/1993 Tanaka ..... 335/78

6,023,212 A * 2/2000 Mader ..... 335/202

OTHER PUBLICATIONS

Patent Abstracts of Japan, Publication No. 11–096875 dated Apr. 9, 1999, 1 pg.

Patent Abstracts of Japan, Publication No. 11–016473 dated Jan. 22, 1999, 1 pg.

Patent Abstracts of Japan, Publication No. 2001–319553 dated Nov. 16, 2001, 1 pg.

* cited by examiner

*Primary Examiner*—Ramon M. Barrera
(74) *Attorney, Agent, or Firm*—Osha & May L.L.P.

(57) ABSTRACT

An electromagnetic relay is simple in construction, can prevent entry of dust, etc. into an interior thereof, enables confirmation of operation, and is provided an operating lever that can be maintained in an operating state. A coil block and a contact switching mechanism are provided on a base plate, a casing covers the base plate, and a movable iron piece is turned by magnetizing and demagnetizing the coil block, and a movable contact piece is operated to make and break contacts. An operating part that is turned by directing pushing the movable iron piece is arranged on an upper surface of the casing, and covered by a cover. An operating lever is mounted on the cover in a manner to enable sliding operation. The operating lever can be positioned in a closed position, in which an operating part is covered, a first opened position, in which the operating part is exposed, and a second opened position, in which the operating part is operated, respectively.

15 Claims, 17 Drawing Sheets

ELECTROMAGNETIC RELAY

CROSS-REFERENCE TO RELATED APPLICATIONS

This application claims priority from Japanese Application JP2003-120308, filed on Apr. 24, 2003.

BACKGROUND OF THE INVENTION

1. Field of the Invention

The present invention relates to an electromagnetic relay.

2. Description of Related Art

There are conventional electromagnetic relays, in which a turning lever provided on a casing is turned to horizontally move an intermediate member to switch contact closing positions, thereby enabling confirmation of operation (for example, see Patent Document 1).

Also, there are further electromagnetic relays, in which a card provided on a casing is operatively and directly pushed to switch contact closing positions, thereby enabling confirmation of operation (for example, see Patent Document 2).

Also, there are still further electromagnetic relays, in which a push button provided on a casing is operatively slid to switch contact closing positions, thereby enabling confirmation of operation (for example, see Patent Document 3).

[Patent Document 1]

JP-A-11-09875

[Patent Document 2]

JP-A-11-016473

[Patent Document 3]

JP-A-2001-319553

However, all the above-mentioned electromagnetic relays are constructed such that an operating member (turning lever, card, push button) is provided on a casing to directly operate an internal constituent part. Therefore, there is involved a problem that in order to prevent entry of dust, etc. into an interior of the electromagnetic relay, a construction for mounting the operating member on the casing must be made complicate. Also, with the first electromagnetic relay, it is necessary to bend a movable contact piece by converting a turning motion of a lever arm into horizontal motion of the intermediate member, thus causing a problem of lack in stability of motion. Further, with the second and third electromagnetic relays, it is not possible to maintain the operating member in a locked state.

SUMMARY OF THE INVENTION

Hereupon, it is an object of the invention to provide an electromagnetic relay that is simple in construction, can prevent entry of dust, etc. into an interior thereof, enables confirmation of operation, and is provided an operating lever that can be maintained in an operating state.

As measures for solving the problems, the invention provides a electromagnetic relay comprising a coil block and a contact switching mechanism that are provided on a base plate, a casing that covers these elements, a movable iron piece that is turned by magnetizing and demagnetizing the coil block, and a movable contact piece that is operated to make and break contacts, and wherein an operating part that directly pushes the movable iron piece to turn the same is arranged on an upper surface of the casing and covered by a cover, an operating lever is mounted on the cover to enable sliding operation, and the operating lever can be positioned in a closed position, in which the operating part is covered, a first opened position, in which the operating part is exposed, and a second opened position, in which the operating part is operated, respectively.

With such construction, only the sliding operation of the operating lever makes it possible to simply operate and maintain the operating part in an operated state. Also, since the operating part is covered by the cover that is put on the upper surface of the casing, it becomes possible to surely prevent entry of dust, etc. into the casing.

Positioning of the operating lever performed by causing an elastic latch part formed on the operating lever to be latched on latch bearing parts formed in three locations on the cover is preferable in that it can be accommodated by a simple construction.

Preferably, the latch bearing parts differ in dimension, over which they are latched on the elastic latch part since click feeling can be obtained in the operation of the operating lever and the operation is facilitated.

Preferably, the electromagnetic relay further comprises a light emitting diode that generates light upon magnetization of the coil block, and the operating part is united with a holder body that holds the light emitting diode, through the medium of an elastic arm since the light emitting diode can be also held without an increase in the number of parts.

Preferably, the operating lever comprises falling-off preventive projections that abut against the cover to prevent falling-off when it is operatively slid since it is possible to surely prevent the operating lever from falling off due to an erroneous operation.

Preferably, the operating lever comprises, in a separated configuration, an elastic latch part that is latched on and unlatched from the respective latch bearing parts, and a push projection that operates the operating part since it is possible to have the respective functions exhibiting themselves appropriately.

DESCRIPTION OF THE PREFERRED EMBODIMENTS

Figure 1:
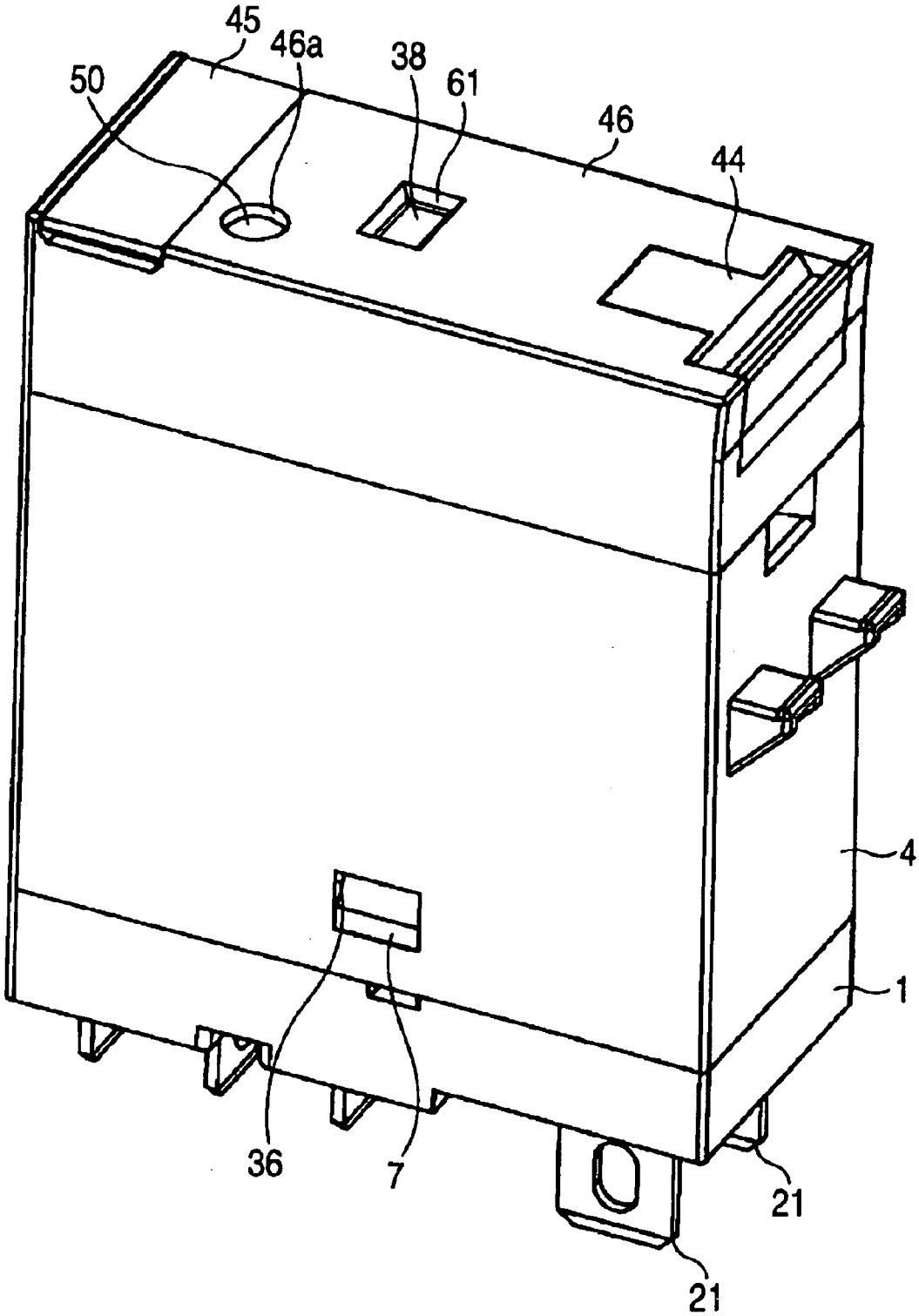
FIG. 1 is a perspective view showing an electromagnetic relay according to an embodiment.

Embodiments according to the invention will be described below with reference to the accompanying drawings.

FIGS. 1 to 4 show an electromagnetic relay according to the embodiment. The electromagnetic relay generally comprises a coil block 2 and a contact switching mechanism 3 that are provided on a base plate 1, a casing 4 covering them, and a display block 5 arranged on an upper surface of the casing 4.

Figure 3:
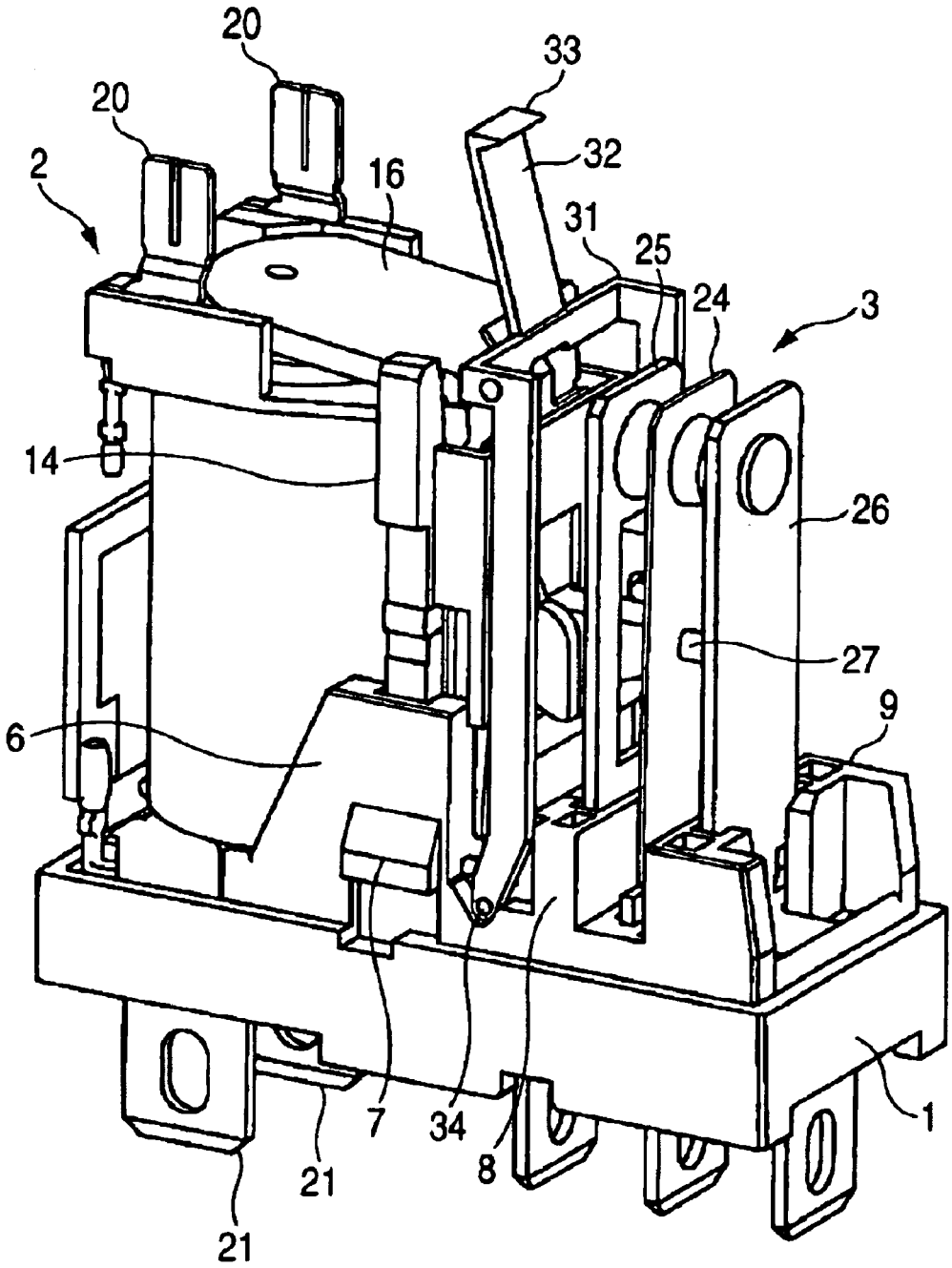
FIG. 3 is a perspective view showing a state, in which a casing is removed from the state shown in FIG. 2.
Figure 5:
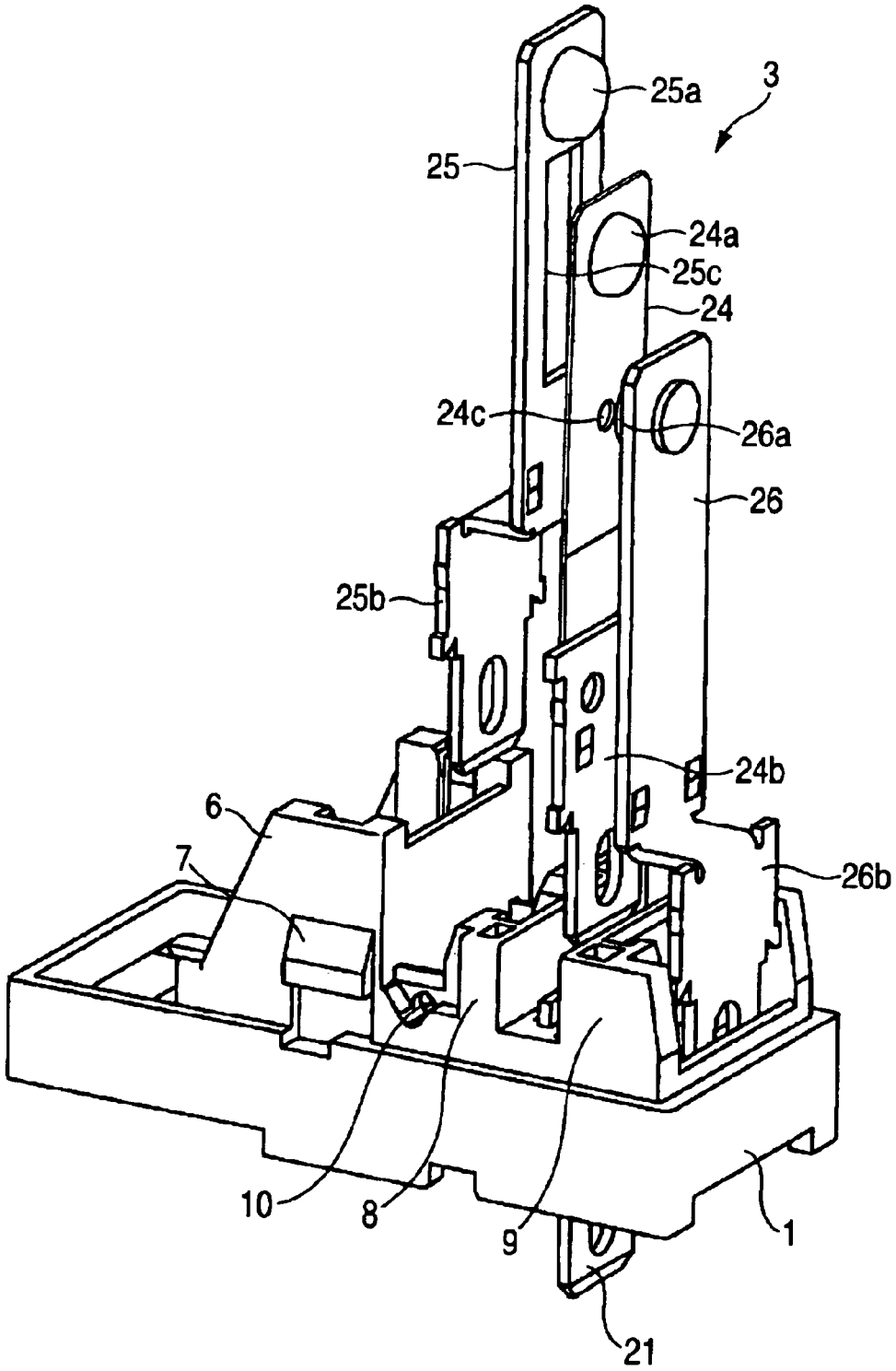
FIG. 5 is an exploded, perspective view showing a base plate and a contact switching mechanism.

As shown in FIGS. 3 and 5, the base plate 1 is compartmented by a first insulation wall 6 into a first region, in which the coil block 2 is arranged, and a second region, in which the contact switching mechanism 3 is arranged. The first insulation wall 6 is formed on side portions thereof with latch projections 7 that latch on latch holes 36, described later, of the casing 4 whereby the casing 4 is mounted on the base plate 1. Also, the second region is compartmented by a second insulation wall 8 and a third insulation wall 9 into a region, in which a first stationary contact piece 25 is fixed, a region, in which a movable contact piece 24 is fixed, and a region, in which a second stationary contact piece 26 is fixed. The second insulation wall 8 is formed on side portions thereof with bearing holes 10, by which an indicator 31 described later is rotatably supported.

Figure 4:
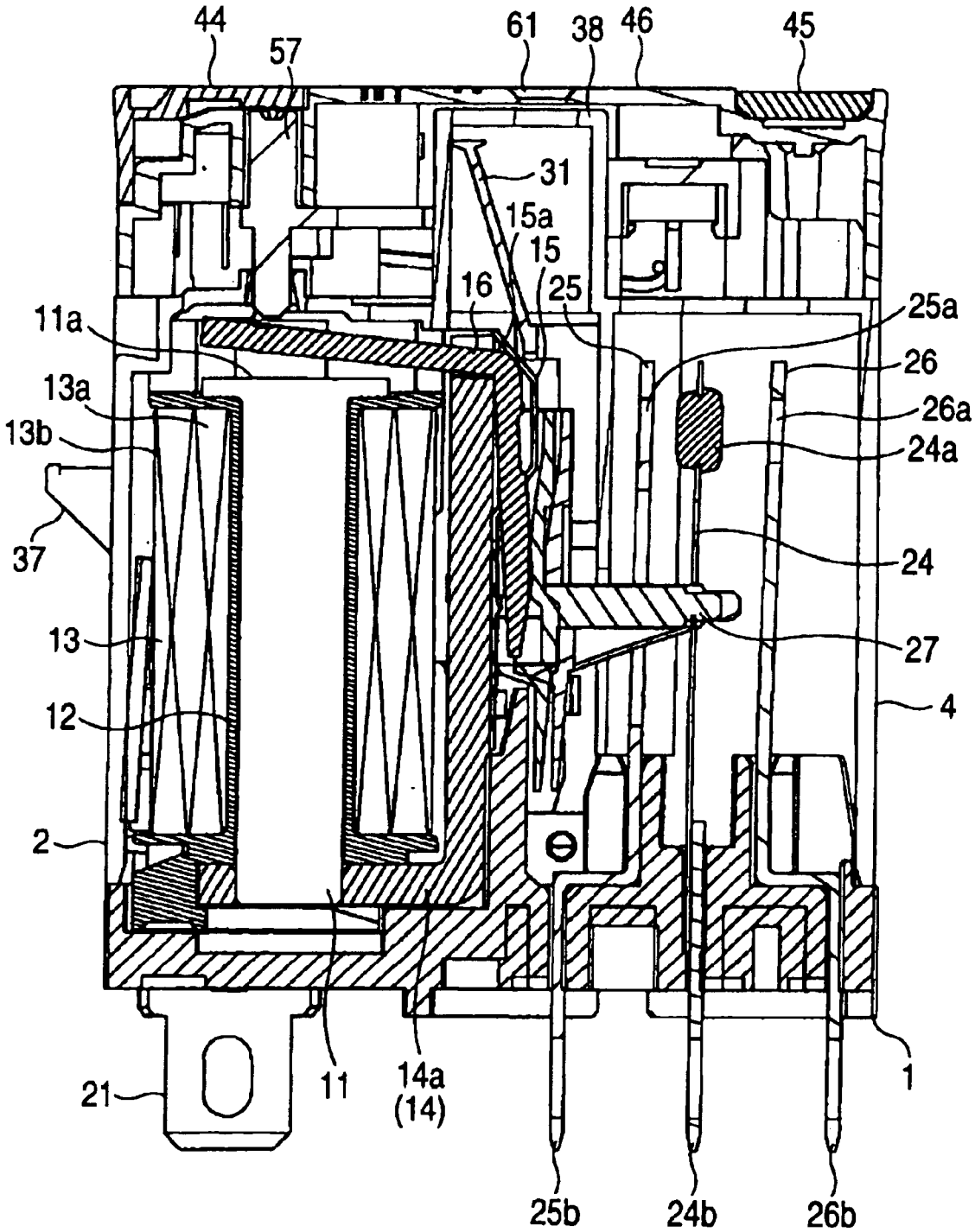
FIG. 4 is a cross sectional view corresponding to FIG. 1.
Figure 8:
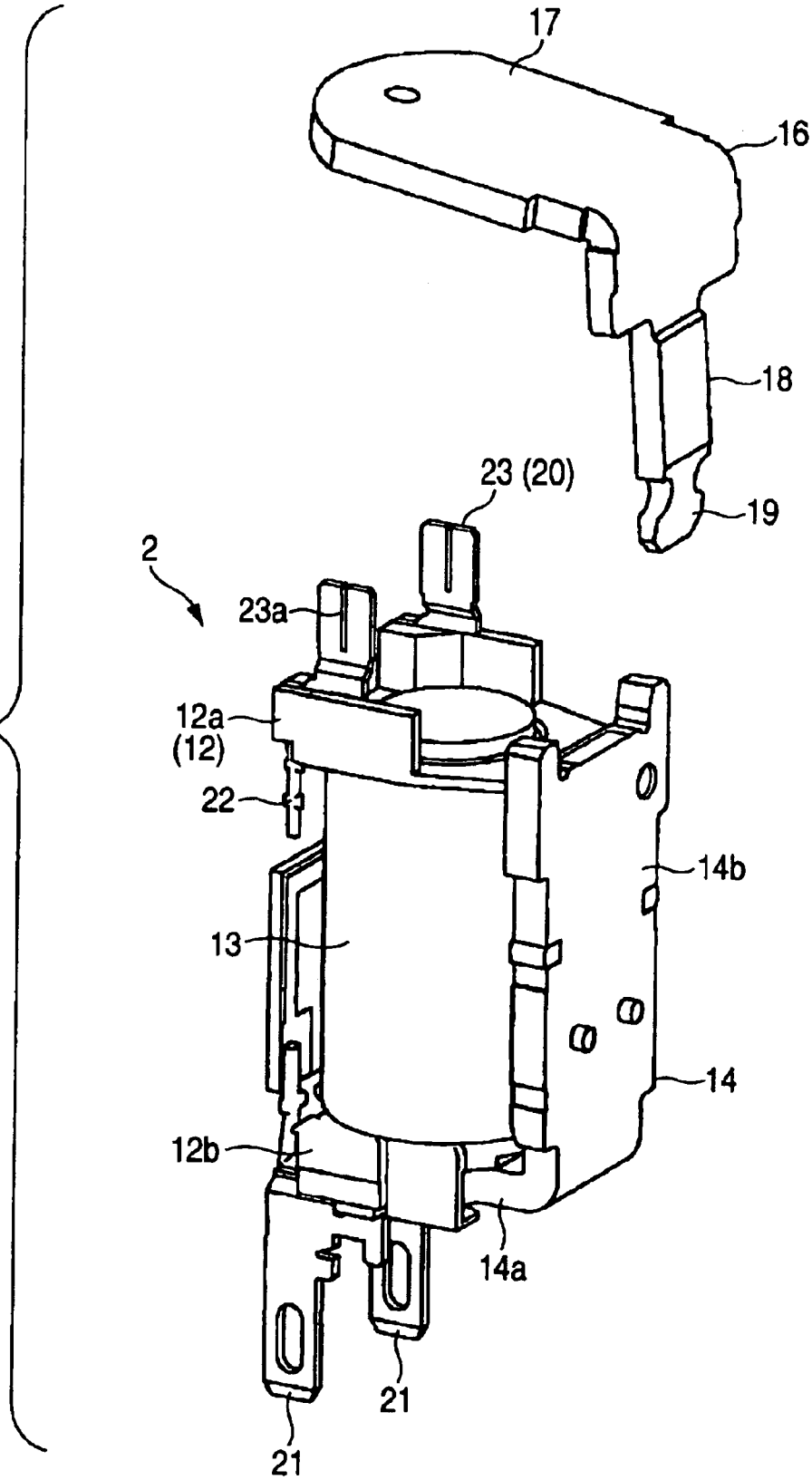
FIG. 8 is a perspective view showing a coil block and a movable iron piece.

As shown in FIGS. 4 and 8, the coil block 2 comprises a coil 13 wound around an iron core 11 with a spool 12 therebetween. A horizontal portion 14*a* of a yoke 14 bent into a substantially L-shape is fixedly caulked to a lower end of the iron core 11. A vertical portion 14*b* of the yoke 14 extends upward along the wound coil 13 and secures to a side thereof a hinge spring 15. A movable iron piece 16 is supported on an upper end of the vertical portion 14*b* of the yoke 14 to be able to rock.

As shown in FIG. 8, the movable iron piece 16 comprises a bias-bearing portion 18 having a small width and extended from an attracted portion 17 that is attracted by an attracting surface 11*a* of the iron core 11, with a bent portion therebetween. The bias-bearing portion 18 is formed at a tip end thereof with a connection 19 for connection to a card 27 described later. Since the bias-bearing portion 18 is biased by a bias piece 15*a* of the hinge spring 15, the movable iron piece 16 turns such that the attracted portion 17 separates from the attracting surface 11*a* of the iron core 11, provided that the coil block 2 is in a demagnetized state.

As shown in FIG. 8, the spool 12 has first coil terminals 20 fixed to an upper-end flange 12*a* and has second coil terminals 21 fixed to a lower-end flange 12*b*. The first coil terminals 20 have the coil 13 wound around legs 22 at lower ends thereof, and have lead wires 54 from a LED 50, described later, connected to electric connections 23 having a flat upper surface. The electric connections 23 are formed centrally thereof with vertically extending ridges 23*a* so that electric connection with the lead wire 54 can be surely performed.

As shown in FIG. 4, the coil 13 comprises first coils 13*a* wound around a drum portion of the spool 12 and connected to the first coil terminals 20, respectively, and second coils 13*b* wound around an outer periphery of the wound coil 13 and connected to the second terminals 21, respectively. Thereby, when voltage is applied to the second terminals 21 to carry current to the second coils 13*b* on the outer periphery, the action of electromagnetic induction generates induced electromotive forces in the first coils 13*a* on an inner peripheral side, thus enabling generating an electric potential difference between the first coil terminals 20.

As shown in FIG. 5, the contact switching mechanism 3 comprises the movable contact piece 24, and the first stationary contact piece 25 and the second stationary contact piece 26 that are arranged on both sides of the movable contact piece. The movable contact piece 24 is plate-shaped, has movable contact 24*a*, which are exposed on both surfaces thereof, united with an upper end thereof, and forms a terminal portion 24*b* at a lower end thereof. Also, a through-hole 24*c* is formed below and near the movable contact 24*a*. Both the first stationary contact piece 25 and the second stationary contact piece 26 are plate-shaped and have a first stationary contact 25*a* and a second stationary contact 26*a*, respectively, which contact with and separate from the movable contact 24*a*, united with upper ends thereof. Also, the both stationary contact pieces 25, 26 comprise on lower sides thereof terminal portions 25*b*, 26*b* that are bent in a crank manner and extend from a lower surface of the base plate 1. The first stationary contact piece 25 is formed at an upper side thereof with a slit 25*c* that extends vertically downward from the vicinity of the first stationary contact 25*a*.

Figure 7:
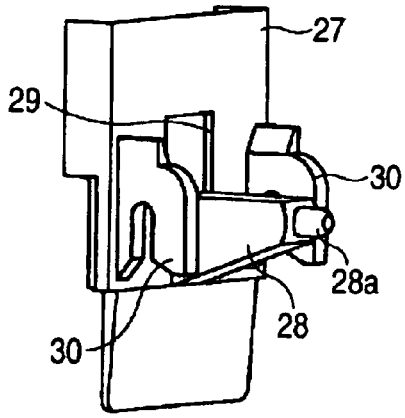
FIG. 7 is a perspective view showing a card.

The movable contact piece 24 acts through the medium of a card 27 latched on one end of the movable iron piece 16. As shown in FIG. 7, the card 27 comprises a push projecting part 28 centrally on a plate-shaped body, and a projection 28*a* provided on a tip end of the push projecting part extends through the through-hole 24*c* of the movable contact piece 24. A rectangular hole 29 is formed above and near the push projecting part 28 and connects thereto the connection 19 of the movable iron piece 16. A substantially U-shaped guide bearing part 30 is formed on both sides of the card 27.

Figure 6:
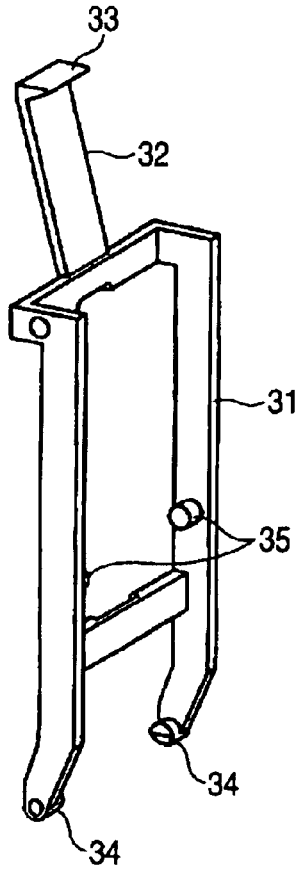
FIG. 6 is a perspective view showing an indicator.

The motion of the movable contact piece 24 caused by the card 27 can be easily confirmed by the indicator 31. As shown in FIG. 6, the indicator 31 is substantially frame-shaped, and formed centrally of a connecting part on an upper end thereof with a display piece 32. A tip end of the display piece 32 is bent substantially at a right angle to define a visible part 33. Spindles 34 projecting in opposite directions are formed at lower ends of both sides of the indicator, and the spindles 34 engage with the bearing holes 10 of the base plate 1 to thereby mount the indicator in a rotatable manner. Also, guide projections 35 projecting in opposite directions are formed centrally of the both sides of the indicator to be guided by the guide bearing part 30 of the card 27 whereby the both are made to be able to act integrally. A pivotal center (the spindles 34) of the indicator 31 is positioned in opposition to the display piece 32 relative to a pushed position of the card 27. Therefore, it is possible to amplify movement of the display piece 32 relative to movement of the card 27.

Figure 2:
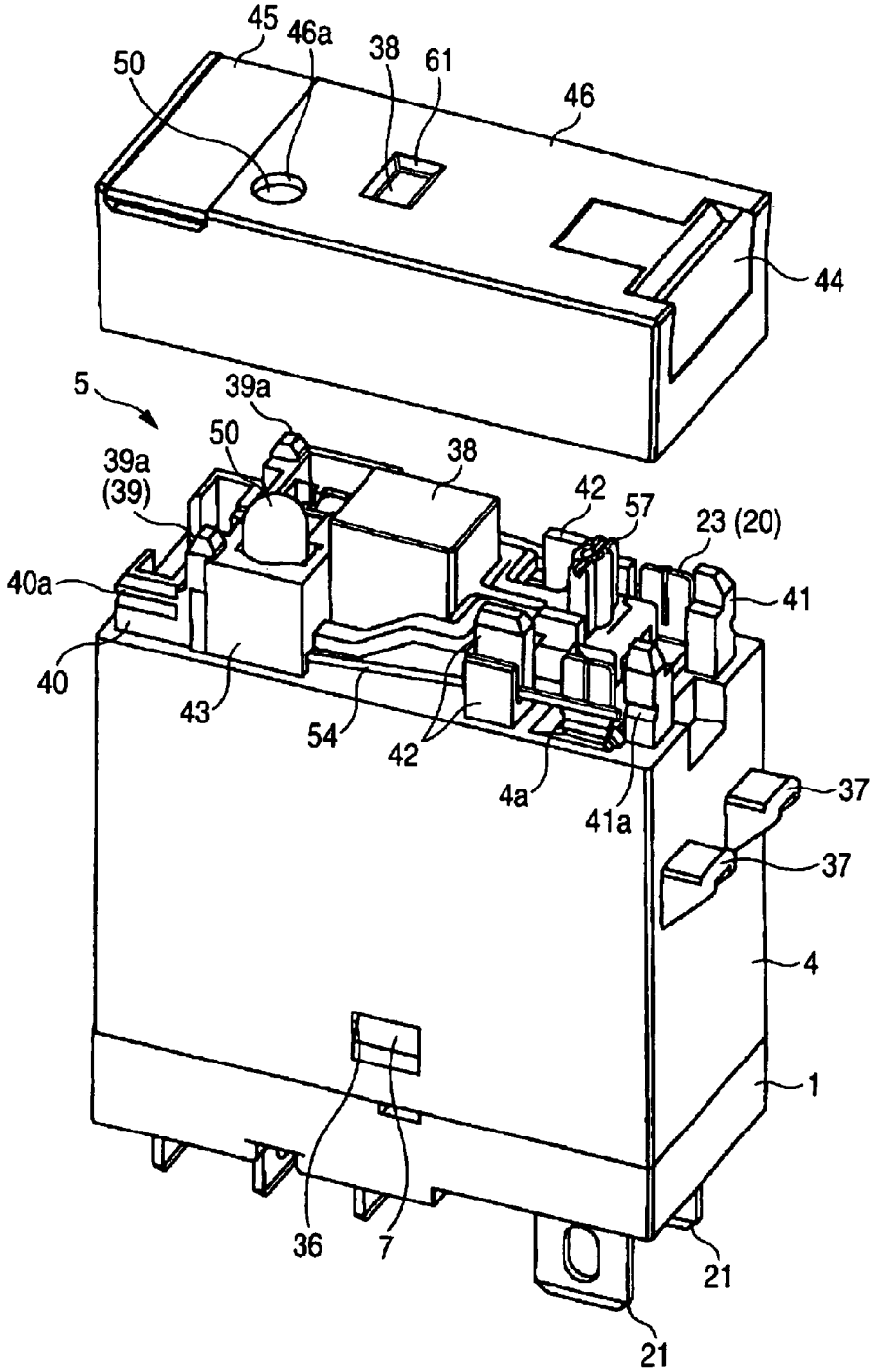
FIG. 2 is a perspective view showing a state, in which a cover of FIG. 1 is removed.

The casing 4 is in the form of a box opened at an underside as shown in FIG. 2, and obtained by molding a translucent resin material. The casing 4 is formed centrally of lower portions of both sides with the latch holes 36, respectively, having the latch projections 7 of the base plate 1 latching thereon and unlatching therefrom. Also, the casing 4 is formed at one end surface thereof with pawls 37 that are held by fingers when the electromagnetic relay is dismounted after it is mounted on a panel (not shown) arranged in a vertical surface. Also, the casing 4 is provided centrally of an upper surface thereof with a display guide 38, on one end side with latch pieces 39 and a reinforcement 40 that project from the upper surface, on the other end side with first guide pieces 41 and second guide pieces 42, both of which project from the upper surface, and is formed with a slit 4*a*. The display guide 38 is box-shaped to provide a space, in which the display piece 32 of the indicator 31 acts. The latch pieces 39 guide a LED holder 43 between them and the display guide 38, and latch pawls 39*a* at top ends thereof prevent the LED holder 43 from falling off the casing 4. The reinforcement 40 reinforces the latch pieces 39 and is provided with latch pawls 40*a* having second latch pawls 69 of a cover 46, described later, latching thereon and unlatching therefrom. The first guide pieces 41 are formed centrally of a side thereof with a latch groove 41*a*, on which first latch pawls 62*a* (see FIG. 11) of the cover 46 are latched, and taper to facilitate mounting of the cover 46. The second guide pieces 42 comprise a pair of projecting plates arranged in parallel to guide lead wires 54 extending from the LED 50. The electric connections 23 of the first coil terminals 20 are inserted through the slit 4*a*.

The display block 5 is constructed as shown in FIG. 2 such that the LED holder 43 is arranged on the upper surface of the casing 4 and covered by the cover 46 provided with an operating lever 44 and a display panel 45.

Figure 9A:
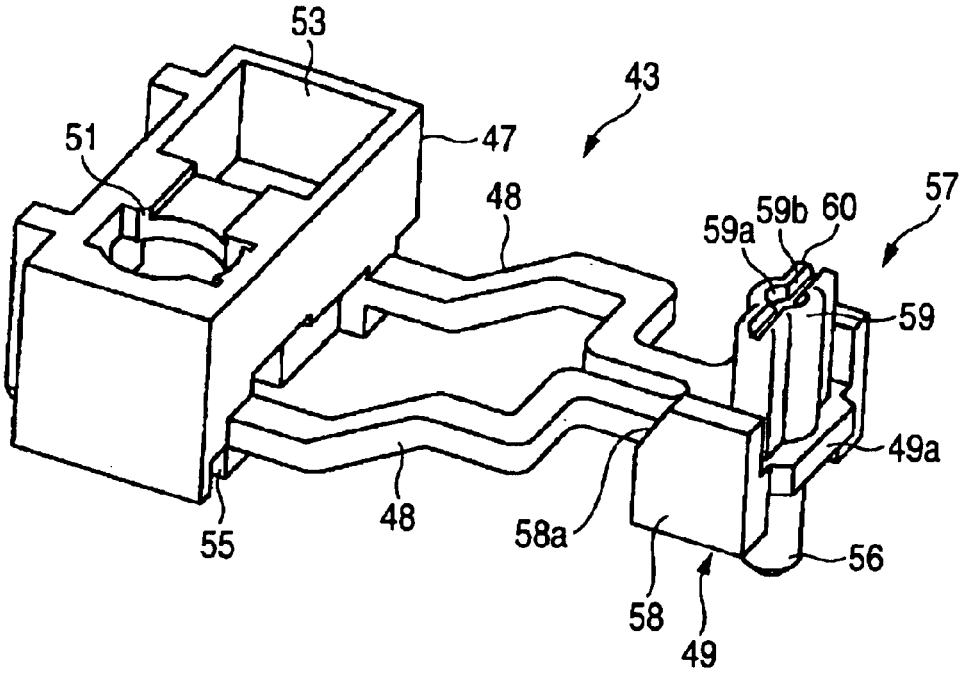
FIG. 9A is a perspective view showing a LED holder.
Figure 9B:
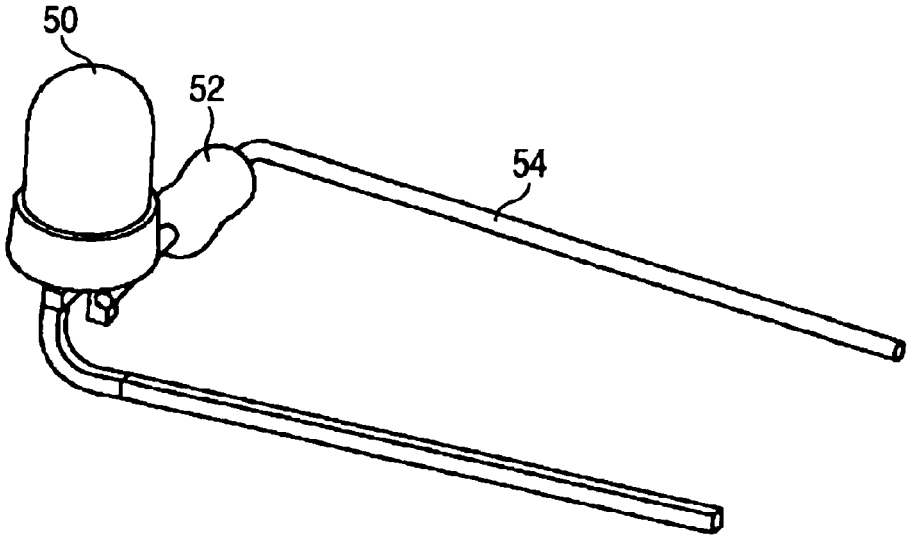
FIG. 9B is a perspective view showing a LED.
Figure 10A:
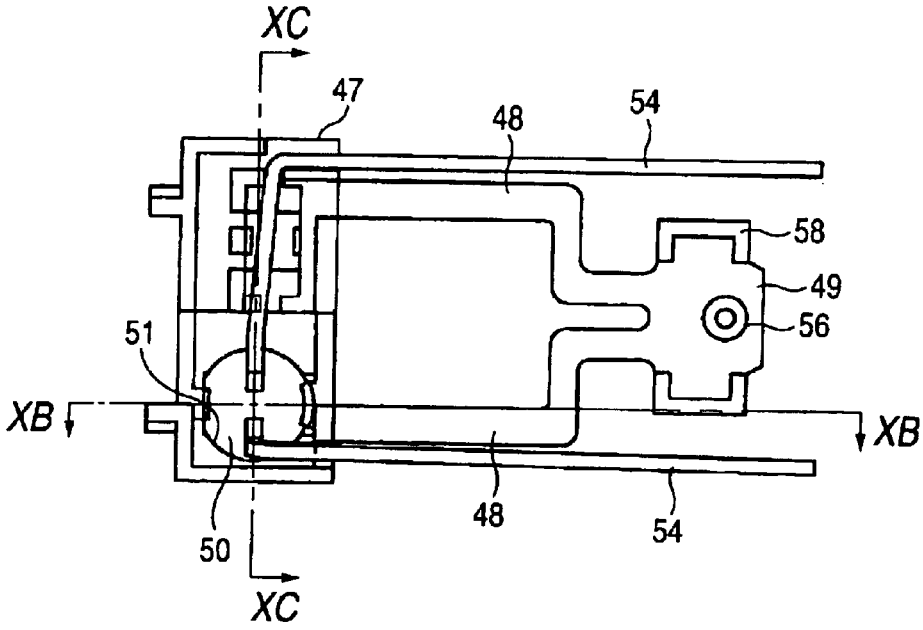
FIG. 10A is a bottom view showing a LED holder.
Figure 10B:
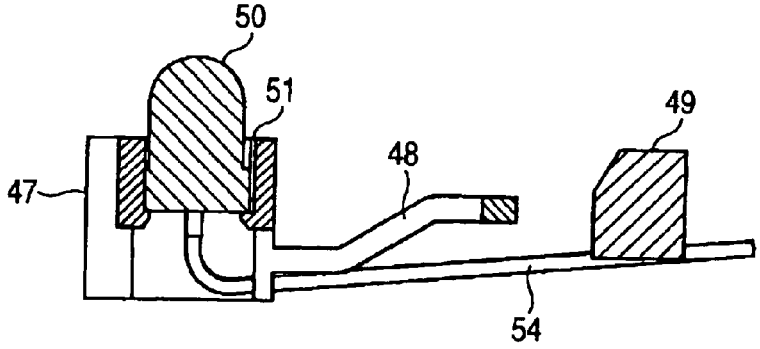
FIG. 10B is a cross sectional view taken along the line XB—XB in FIG. 10A, and FIG. 1° C. is a cross sectional view taken along the line XC—XC in FIG. 10A.
Figure 10C:
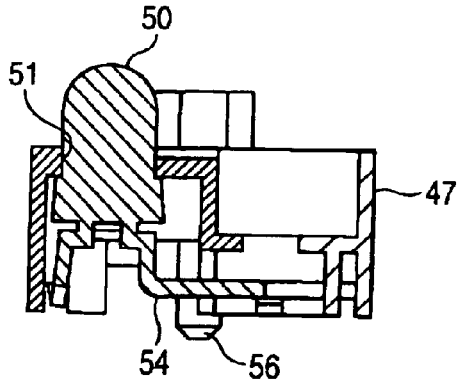

As shown in FIG. 9A, the LED holder 43 comprises elastic arms 48 extending from a holder body 47, and an operating part 49 formed at tip ends of the arms.

The holder body 47 is formed with a guide hole 51 that guides the LED 50, and an escape hole 53 that avoids interference with a resistor 52 connected to the LED 50. The lead wires 54 extending from the LED 50 are pulled out through a notch 55 formed at a corner on an underside of the holder body 47.

The elastic arms 48 are formed in a manner to extend laterally from both ends on a side edge of the holder body 47, head obliquely upward, bend toward each other, and connect to the operating part 49. Thereby, the elastic arms 48 are easily deformed and interference with the projecting portions of the casing 4 is avoided.

The operating part 49 comprises a push part 56 projecting downward from a center of an underside of a support plate 40*a* contiguous to the elastic arms 48, a first bias bearing part 57 projecting upward from a center of an upper surface of the support plate, and second bias bearing parts 58 projecting upward from both sides of the upper surface. The push part 56 pushes one end of the movable iron piece 16 to be able to operate the movable contact piece 24 through the medium of the card 27. The first bias bearing part 57 comprises a central columnar part 59 and extension parts 60 extending on both sides of the columnar part. A recess 59*a* is provided centrally of the columnar part 59 and a groove 59*b* is formed to be contiguous to the extension parts 60 and the columnar part 59. The recess 59*a* prevents offset caused when the first bias bearing part 57 is pushed by a pointed member such as pen, etc., and the groove 59*b* prevents offset caused when the first bias bearing part is pushed by a plate-shaped member such as wrench, etc. The second bias bearing parts 58 are cut off at upper corners toward holder body 47 to define inclined surfaces 58*a*. The inclined surfaces 58*a* are pushed by push projections 74 of the operating lever 44 whereby the push part 56 can push the attracted portion 17 of the movable iron piece 16.

In this manner, the LED holder 43 is constructed such that not only it can hold the LED 50 but also the operating part 49 can operate the movable iron piece 16. Accordingly, the number of parts is small and manufacture can be made inexpensive. Also, the LED holder 43 is excellent in workability since it can be assembled only by placing it on the upper surface of the casing 4.

Figure 11:
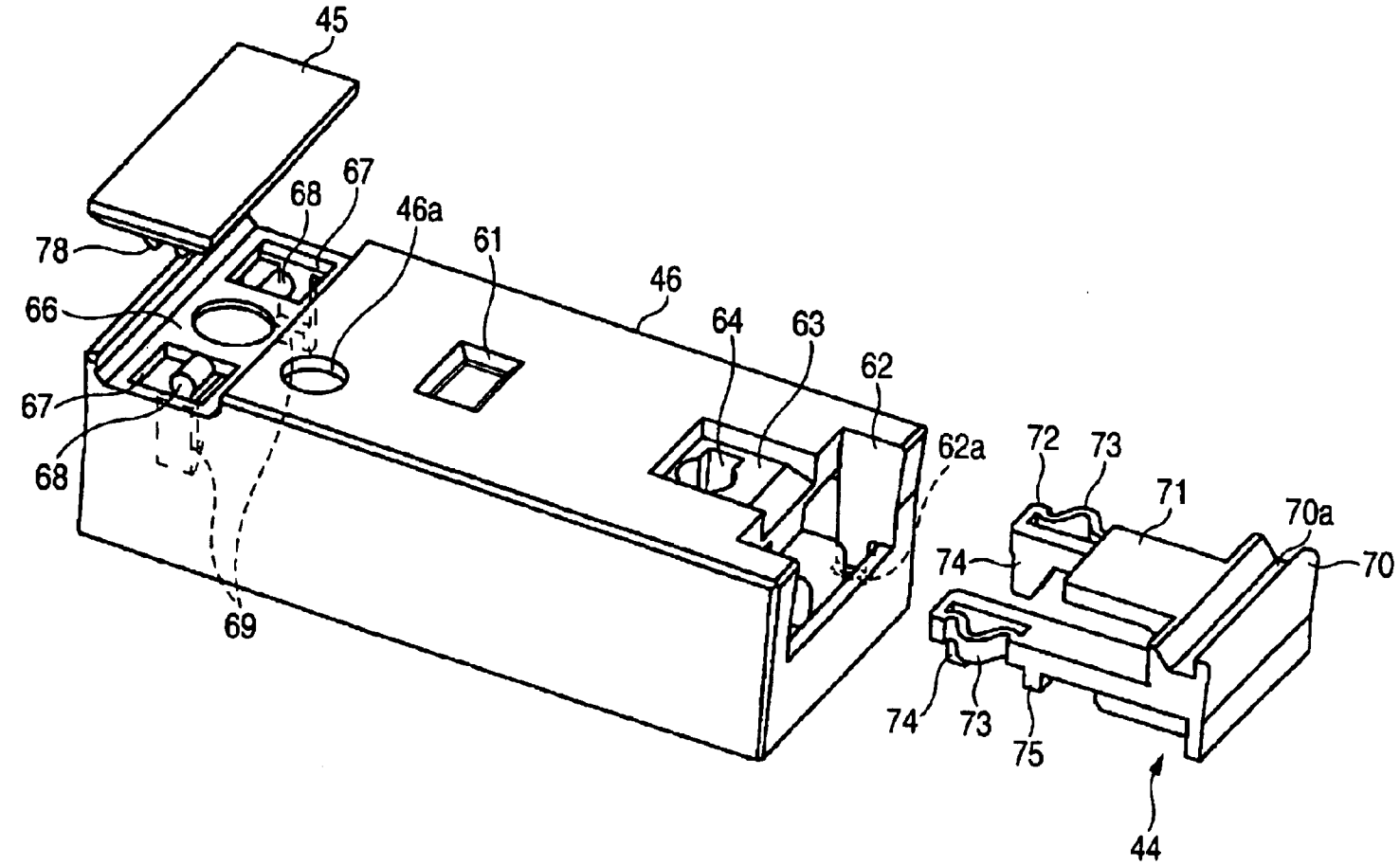
FIG. 11 is an exploded, perspective view showing a cover.
Figure 12A:
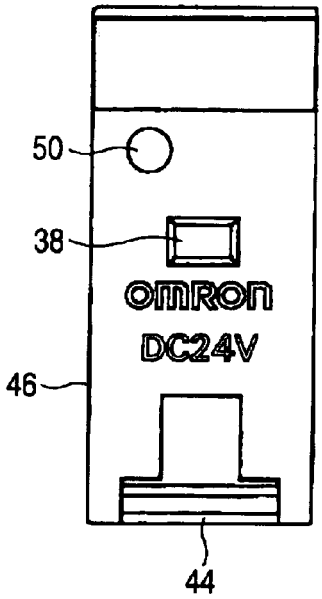
FIG. 12A is a plan view showing the cover.
Figure 12B:
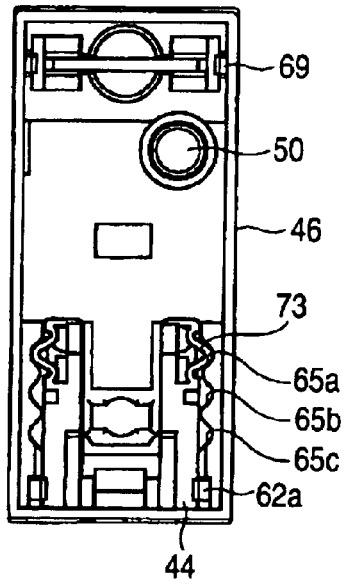
FIG. 12B is a bottom view corresponding to FIG. 12A.
Figure 12C:
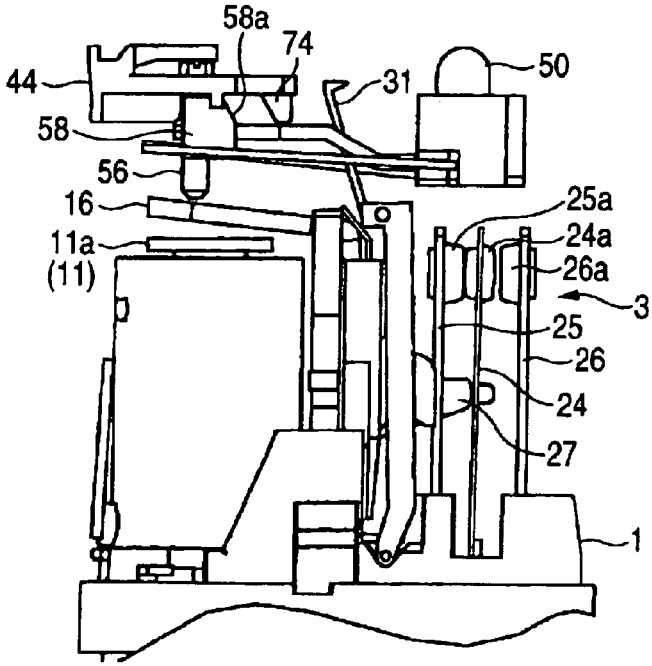
FIG. 12C is a partial, front view showing an internal mechanism.

As shown in FIGS. 11 and 12, the cover 46 is box-shaped with an underside thereof opened, and formed centrally of an upper wall with a window 61. The window 61 makes the display piece 32 visible when the indicator 31 acts. The cover 46 is formed at one end thereof with an opening 62, in which the operating lever 44 is mounted, and a recess 63 contiguous to the opening 62 and having a smaller width than that of the opening 62. The opening 62 is opened to the upper surface and a side of the cover 46. The recess 63 is disposed on the upper surface of the cover 46 and formed centrally thereof with an insertion hole 64, in which the first bias bearing part 57 of the LED holder 43 is positioned to be able to be pushed. Formed on both sides of the opening 62 on an underside (roof surface) of the upper wall of the cover 46 are first, second, and third engagement bearing parts 65*a*, 65*b*, 65*c* that comprise three continuous wave-shaped cavities. The first, second, and third engagement bearing parts 65*a*, 65*b*, 65*c* position the operating lever 44 described later in a closed position, a first opened position, and a second opened position, respectively. In this case, by varying cavity dimensions of the first, second, and third engagement bearing parts 65*a*, 65*b*, 65*c*, click feeling at the time of sliding operation of the operating lever 44 can be varied. Also, first latch pawls 62*a* are formed on inner sides of the opening 62, and the latch grooves 41*a* of the first guide pieces 41 projecting from the upper surface of the casing 4 latch on and unlatch from the first latch pawls. Also, the cover 46 is formed at the other end thereof with a panel recess 66 for mounting therein of the display panel 45. Rectangular-shaped communication holes 67 are formed on both sides of the panel recess 66 to allow mounts 68 to project thereinto. The mounts 68 are rod-shaped to have across-section, in which a circular portion gradually increases in width to extend to a trapezoidal portion. The mounts 68 extend on a back surface of the recess 66 in a widthwise direction and are free at one ends within the communication holes 67. And, the mounts 68 not only serve as mounting of the display panel 45 but also reinforce portions that are thinned by formation of the recess 66, and make flow of a resin at the time of molding favorable. Second latch pawls 69 extending vertically in the vicinity of the communication holes 67 are formed on an inner side of the cover 46, and latch on and unlatch from the latch grooves 40*a* formed on the reinforcement 40 of the casing 4. Although the second latch pawls 69 are provided on the inner side, the presence of the communication holes 67 enables molding of the cover 46 without the need of a slide die. Also, a through-hole 46*a* for exposure of the LED 50 is formed in the vicinity of the window 61.

The operating lever 44 comprises, as shown in FIG. 11, an operating part 70, a closing part 71, and latch parts 72. An upper surface and sides of the operating part 70 closes the opening 62 of the cover 46. A groove 70*a* is formed on the upper surface of the operating part 70 to extend in a widthwise direction. Nails of fingers hold on the groove 70*a* to slidingly operate the operating lever 44 relative to the cover 46. The closing part 71 extends horizontally from the operating part 70 and is positioned in the recess 63. Thereby, the first bias bearing part 57 positioned in the insertion hole 64 is covered by the closing part. The latch parts 72 extend from the operating part 70 to be positioned below both sides of the closing part 71. The latch parts 72 are provided at sides of tip ends thereof with mountain-shaped elastic expanded portions 73 and formed at undersides of the tip ends thereof with push projections 74. The elastic expanded portions 73 latch on and unlatch from the first, second, and third engagement bearing parts 65*a*, 65*b*, 65*c*, respectively, formed on the roof surface of the cover 46 to be positioned in the closed position (see FIG. 12), the first opened position (see FIG. 13), and the second opened position (see FIG. 14), respectively. By sliding the operating lever 44, the push projections 74 push the second bias bearing parts 58 of the LED holder 43. Also, the latch parts 72 are formed at undersides thereof with falling-off preventive projections 75 that abut against tip ends of the guide projections 35 to prevent the operating lever from falling off the cover 46.

Figure 15A:
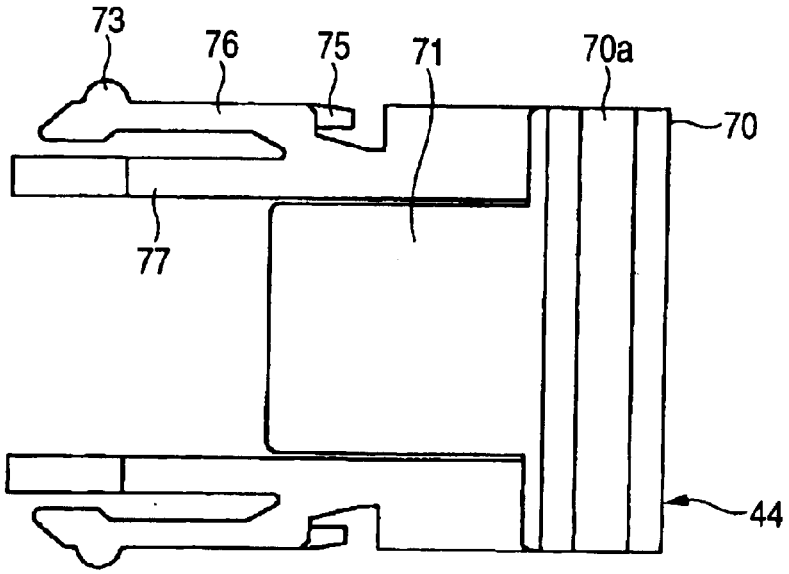
FIGS. 15A and 15B show an operating lever according to another embodiment, FIG. 15A being a plan view, and FIG. 15B being a front view.
Figure 15B:
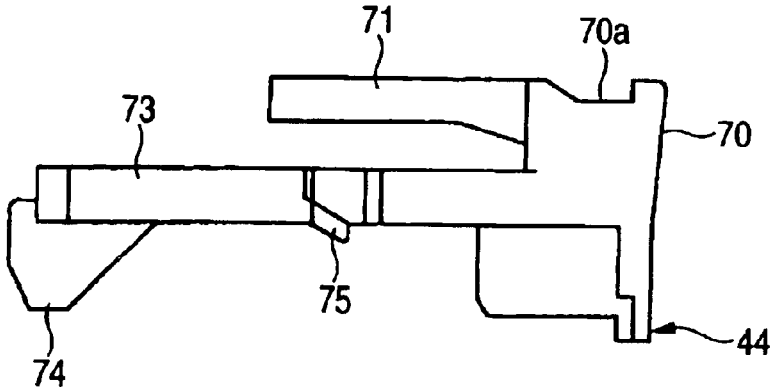

In addition to the above structure, the operating lever 44 may be structured as shown in FIG. 15 such that a tip end of the respective latch parts 72 is divided into a first elastic piece 76 formed with the elastic expanded portion 73 and a second elastic piece 77 formed with the push projection 74. With this structure, latching and unlatching of the elastic expanded portions 73 of the first elastic pieces 76 from the engagement bearing part 65 of the cover 46, and pushing of the second bias bearing parts 58 of the LED holder 43 by means of the push projection 74 of the second elastic pieces 77 can be performed independently of each other. Thereby, elastic forces of the second elastic pieces 77 can absorb dispersion in motion of the movable iron piece 16, that is, dispersion in pushing amount by the LED holder 43.

As shown in FIG. 11, the display panel 45 allows a desired display to be applied on a surface of a plate-shaped body thereof by printing, adhering of a label, and is formed at both ends of a back surface thereof with latch pawls 78 of a substantially C-shaped cross-section, respectively. The respective latch pawls 78 latch on the mounts 68 that project into the communication holes 67 of the cover 46 to secure the display panel 45 to the panel recess 66. Since the latch pawls 78 are provided on both sides, it can make the mounting state of the display panel 45 stable without the generation of warp or the like.

Subsequently, a method of assembling the electromagnetic relay will be described.

In a separate process, the coil 13 is beforehand wound around the iron core 11 with the spool 12 therebetween and the yoke 14 is caulked and secured to the iron core to form the coil block 2. Ends of the coils 13*a*, 13*b*, respectively, wound around inner and outer peripheries of the drum portion are coiled around the respective coil terminals 20, 21 that have been insert-molded in the flanges 12*a*, 12*b* of the spool 12.

The contact pieces 24*a*, 25*a*, 26*a* are first press-fitted into the base plate 1 downwardly and the terminal portions 24*b*, 25*b*, 26*b* are caused to project from an underside of the base plate. And, the indicator 31 is mounted such that the spindles 34 thereof are rotatably supported by the bearing holes 10. Subsequently, the card 27 is temporarily held by inserting the projection 28*a* at the tip end thereof into the through-hole 24*c* of the movable contact piece 24 and latching the guide bearing part 30 on the guide projections 35 of the indicator 31.

Subsequently, the coil block 2 is placed on the base plate 1 to have terminal portions of the respective coil terminals 21 projecting from the underside of the base plate. And, the movable iron piece 16 is pivotally arranged with the upper end of the vertical portion of the yoke 14 as a pivot and biased by the bias piece 15*a* of the hinge spring 15, and the connection 19 of the movable iron piece is connected to the rectangular hole 29 of the card 27. In this state, the bias of the hinge spring 15 acts to have the attracted portion 17 of the movable iron piece 16 separating from the attracting surface 11*a* of the iron core 11, and the movable contact piece 24 allows its elastic force to close the movable contact 24*a* relative to the first stationary contact 25*a*.

When assembling of the contact switching mechanism 3 and the coil block 2 to the base plate 1 has been completed, the casing 4 is put on the base plate 1. At this time, the display piece 32 of the indicator 31 is positioned in the display guide 38 of the casing 4, and the electric connections 23 of the first coil terminals 20 project upward through the slit 4*a* of the casing 4.

Subsequently, the LED holder 43 with the LED 50 assembled thereto is placed on the upper surface of the casing 4. The LED holder 43 is inserted between the display guide 38 of the casing 4 and the latch pieces 39 and secured by the latch pawls 39*a*. The lead wires 54 extending from the LED 50 are welded to the electric connections 23 of the first coil terminals 20 that project above the upper surface of the casing 4. Since the ridges 23*a* are formed on the electric connections 23, connection with the lead wires 54 can be surely performed.

Finally, the cover 46 is mounted on the upper surface of the casing 4. The operating lever 44 and the display panel 45 are beforehand mounted to the cover 46. The operating lever 44 is slid into the opening 62 from one end side of the cover 46 to be mounted thereto. The display panel 45 is positioned in the recess 63 from above the cover 46 and mounted with the latch pawls 78 latched on the mounts 68.

Subsequently, an operation of the electromagnetic relay will be described.

In a demagnetized state, in which no current is carried to the coil 13, the movable contact piece 24 is put in an upright position owing to its elastic force, the movable contact 24*a* is closed relative to the first stationary contact 25*a*. The elastic force of the movable contact piece 24 causes the movable iron piece 16 to turn through the card 27 such that the attracted portion 17 separates from the attracting surface 11*a* of the iron core 11. Therefore, the indicator 31 together with the card 27 turns counterclockwise in FIG. 4 about the spindles 34. Accordingly, it is not possible to visually confirm the display piece 32 through the window 61 of the cover 46.

And, when current is carried to the coil 13 for energization, the attracted portion 17 of the movable iron piece 16 is attracted to the attracting surface 11*a* of the iron core 11, and the movable iron piece 16 turns clockwise in FIG. 4. Thereby, the movable contact piece 24 is driven via the card 27 and the movable contact 24*a* is separated from the first stationary contact 25*a* to be closed relative to the second stationary contact 26*a*. Also, as the card 27 moves, the indicator 31 turns clockwise in FIG. 4 about the spindles 34. Thereby, the display piece 32 is positioned in the window 61 of the cover 46 to afford visual confirmation from outside. Accordingly, it is possible with a single glance to grasp the operating state in the contact switching mechanism 3. Also, energization of the coil 13 causes the LED 50 to light, so that it is possible with a single glance to grasp the magnetized state of the coil block 2.

Figure 13A:
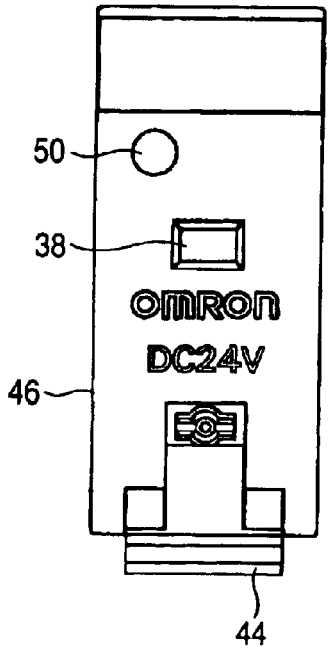
FIGS. 13A to 13C are views showing a state, in which an operating lever is operated to a first opened position.
Figure 13B:
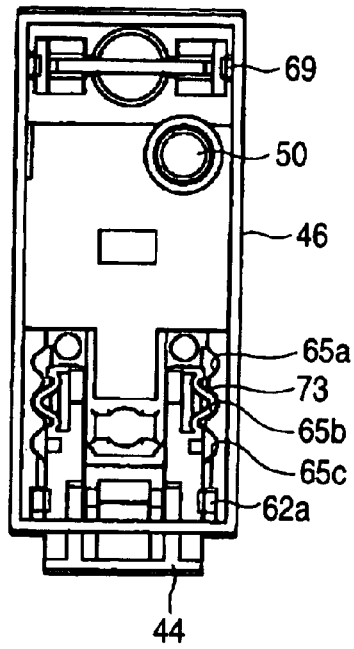
Figure 13C:
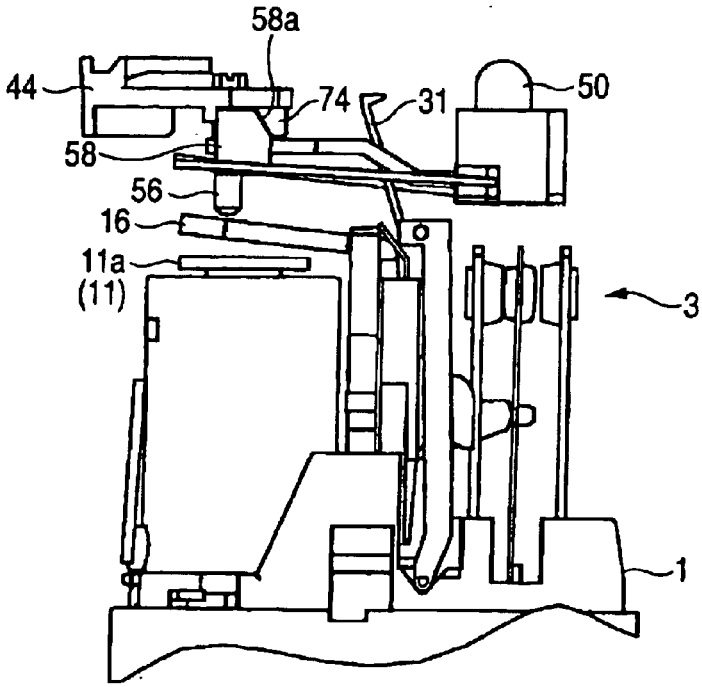

Also, when the operating lever 44 is slid into the first opened position in the demagnetized state, in which no current is carried to the coil 13, the first bias bearing part 57 of the LED holder 43 is exposed as shown in FIG. 13A. Thereby, it is possible to push the first bias bearing part 57 in. When the first bias bearing part 57 is pushed in, the elastic arms 48 are elastically deformed and the push part 56 is moved downward. Thereby, the movable iron piece 16 turns to operate the movable contact piece 24 via the card 27. At this time, as the card 27 moves, the indicator 31 turns and the display piece 32 can be visually confirmed through the window 61. That is, the operating state of the movable iron piece 16 is confirmed.

Figure 14A:
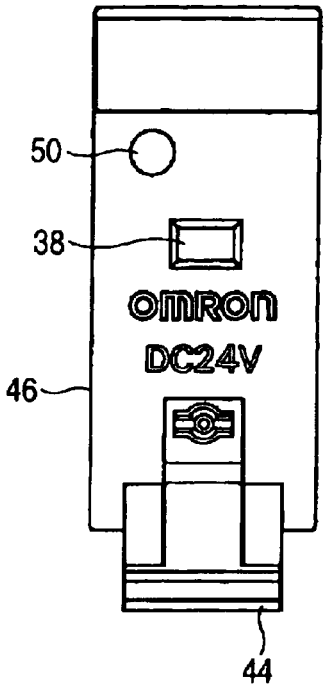
FIG. 14A to 14C are views showing a state, in which the operating lever is operated to a second opened position.
Figure 14B:
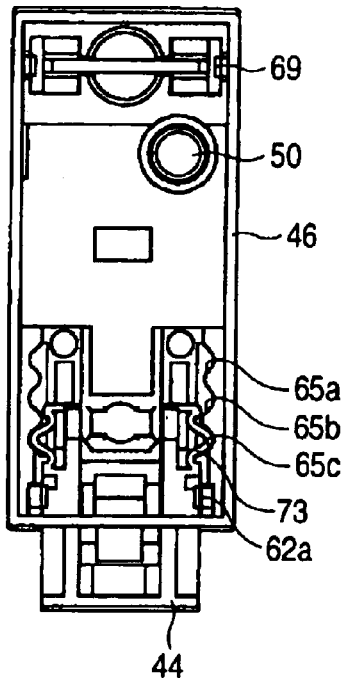
Figure 14C:
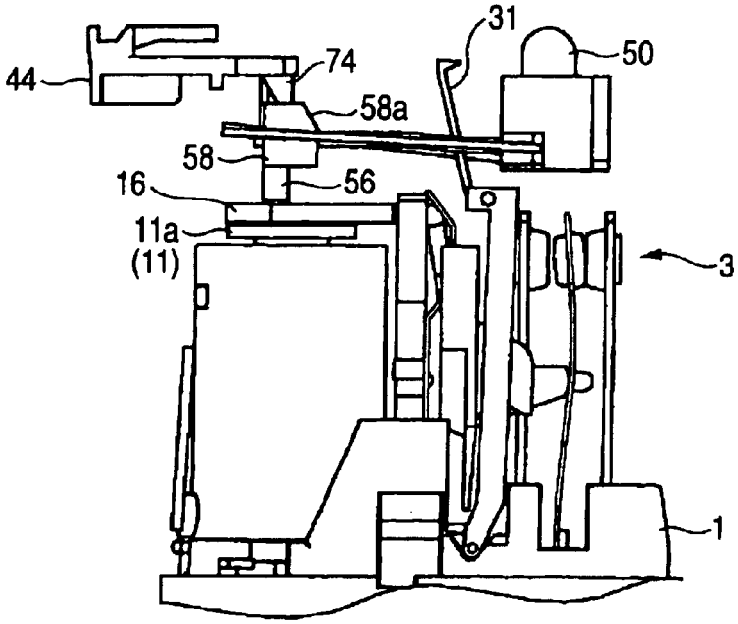

Also, when the operating lever 44 is slid into the second opened position from the first opened position, the push projection 74 of the operating lever 44 pushes the second bias bearing parts 58 of the LED holder 43 to elastically deform the elastic arms 48 as shown in FIG. 14. Thereby, the push projection 74 pushes down the operating part 49 of the LED holder 43, the push part 56 keeps the movable iron piece 16 in a pushed state, and the movable contact 24*a* is closed relative to the second stationary contact 26*a*. At this time, the display piece 32 of the indicator 31 can be visually confirmed through the window 61 of the cover 46. That is, it is possible to confirm the operating state of the movable iron piece 16.

In addition, while the movable contact 24*a* in a single location is caused according to the embodiment to contact with and separate from the stationary contacts 25*a*, 26*a* in two locations, movable contacts in two locations may be caused to contact with and separate from stationary contacts in two locations.

Figure 16:
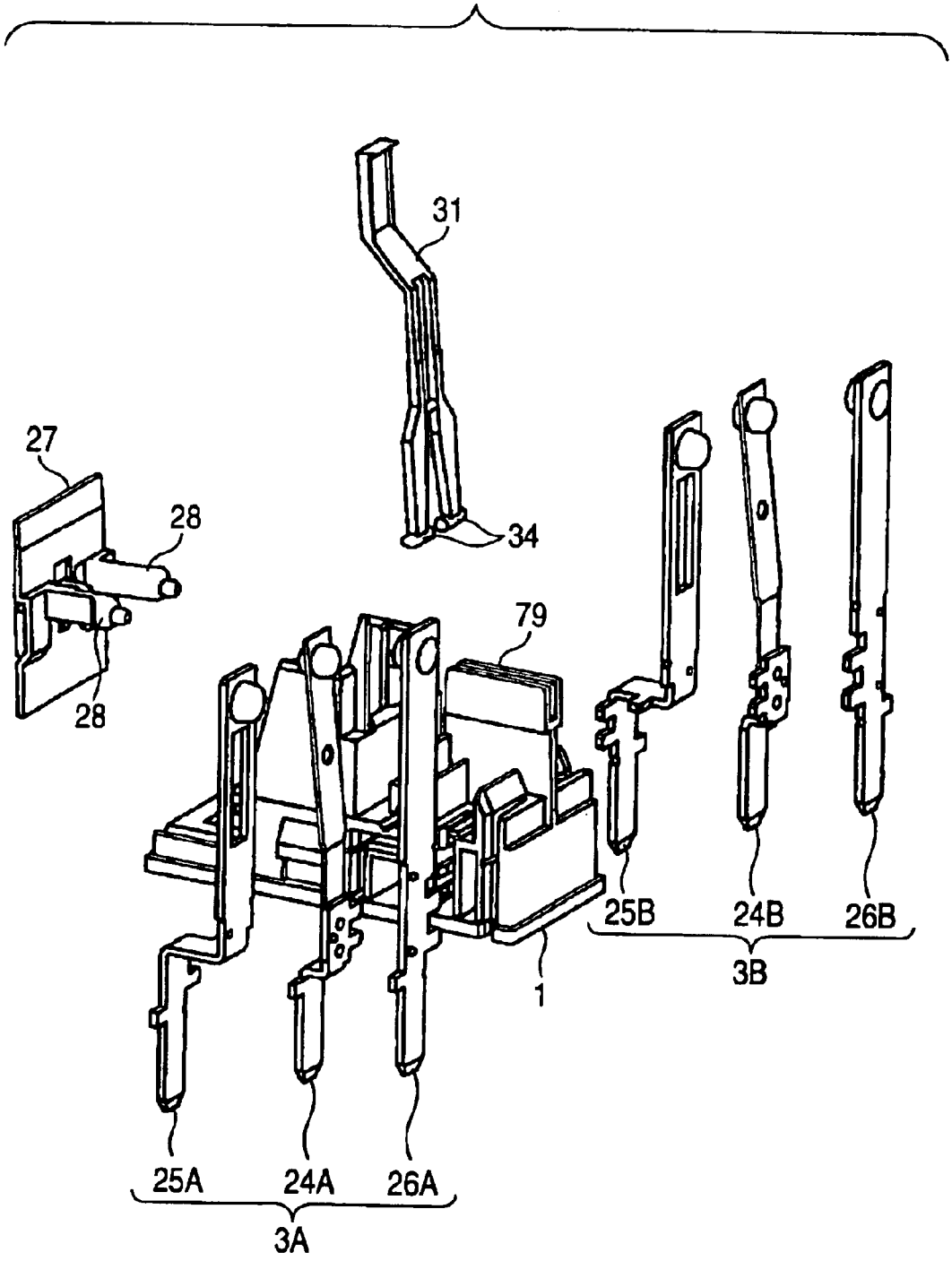
FIG. 16 is an exploded, perspective view showing a base block and a contact switching mechanisms according to another embodiment.

In this case, the base plate 1 is structured as shown in FIG. 16 to afford pressing in from both sides thereof respective contact switching mechanisms 3 comprising movable contacts 24A, 24B and pairs of stationary contacts 25A, 25B, 26A, 26B. And, the second region is compartmented into two widthwise halves by a fourth partition wall 79 to achieve insulation between the respective contact switching mechanisms 3. Also, a lower half of an indicator 31 is bifurcated and formed at lower ends thereof with spindles 34 that project in opposite directions. The spindles 34 are rotatably supported by bearing holes (not shown) that are formed in the fourth partition wall 79. Also, a card 27 is provided in two locations on both sides thereof with push-in projections 28 that push the respective movable contacts 24. In addition, the remainder of the construction is substantially the same as that of the preceding embodiment, and so an explanation therefor is omitted.

Also, while the card 27 and the indicator 31 are composed of separate bodies in the preceding embodiment, they may be of integral construction.

Figure 17B:
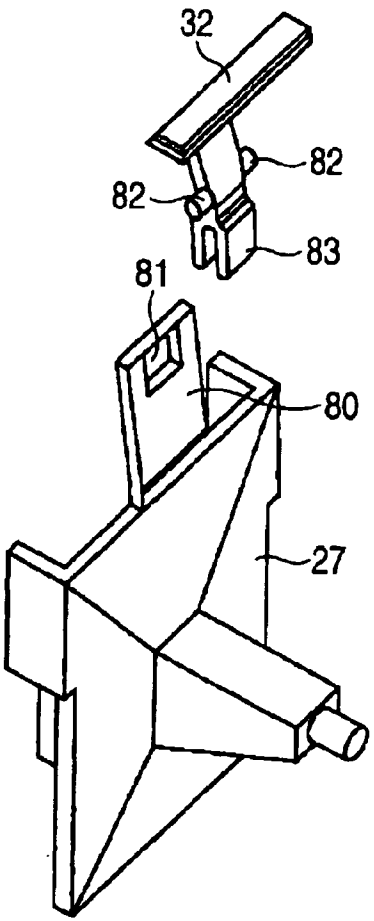
FIGS. 17A and 17B are perspective views showing a card according to another embodiment.
Figure 17A:
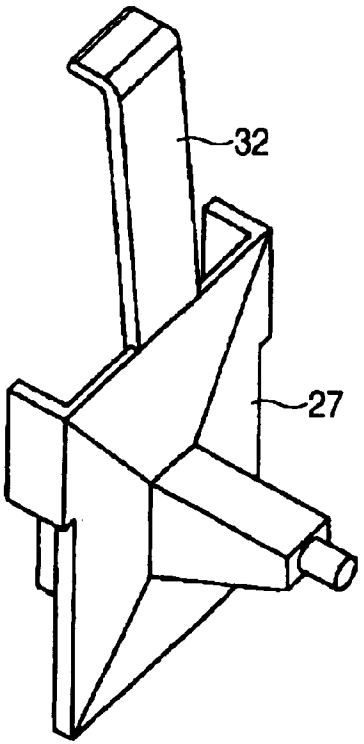

In FIG. 17A, a display piece 32 is integrally formed centrally of an upper edge of a card 27.

In FIG. 17B, formed centrally of an upper edge of a card 27 is an extension 80, to which a display piece 32 is made contiguous. More specifically, the display piece 32 is mounted to the casing 4 in a manner to be rotatable about spindles 82, and a latch piece B3 of the display piece 32 is connected pivotally to a latch bearing hole 81 formed in the extension 80. With such arrangement, a turning range of the display piece 32 can be enlarged as compared with the case where a display piece is extended directly from the card 27. Accordingly, even with an electromagnetic relay that is small in size and involves small movements of the card 27, the motion of the display piece 32 can be amplified, so that the construction makes it possible to perform sure confirmation of the operation. Also, since the display piece 32 is pivotally mounted to the casing 4, it is possible to restrict an occupied space to achieve miniaturization of the electromagnetic relay.

Figure 18:
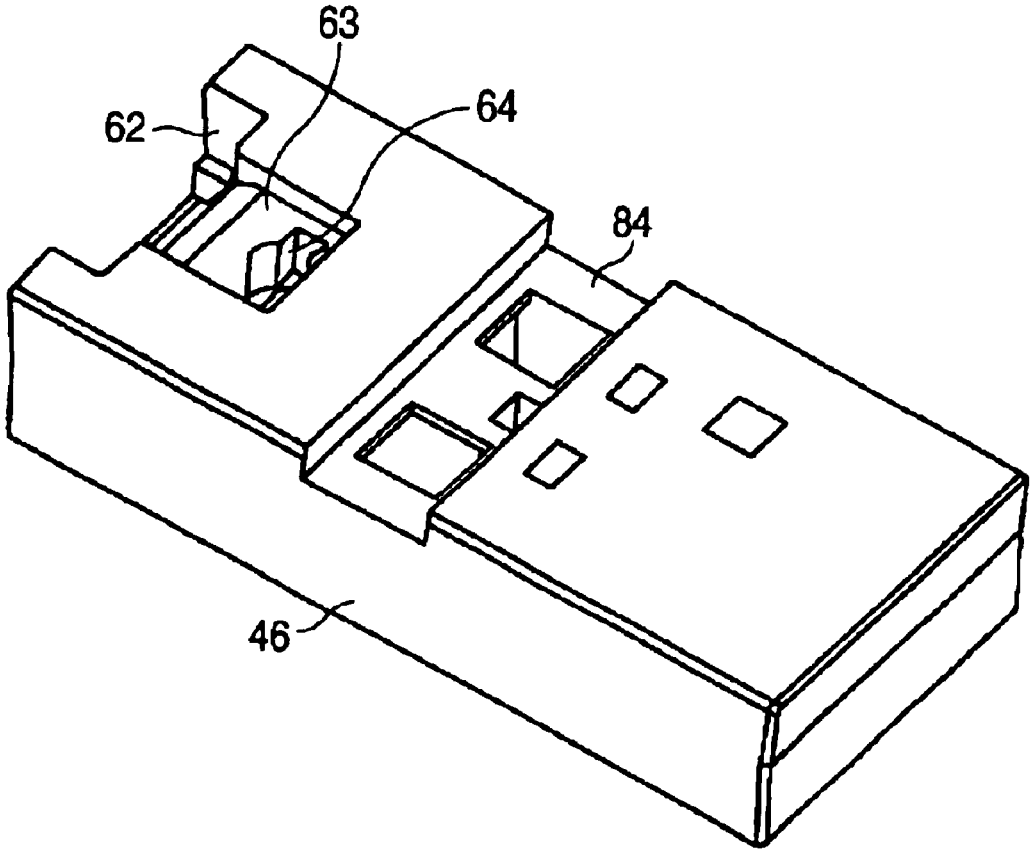
FIG. 18 is a perspective view showing a card according to a further embodiment.

In this case, the cover 46 can be modified in a manner shown in, for example, FIG. 18. That is, a panel recess 66 may be formed centrally of the cover 46 to afford mounting the display panel 45 in the central panel recess 66.

As apparent from the above description, according to the invention, the upper surface of the casing is covered by the cover and the operating lever provided on the cover is used to turn the movable iron piece via the operating part, so that it becomes possible to surely prevent entry of dust, etc. into an interior of the casing. Also, since the operating lever can be positioned in three locations, it becomes possible to simply operate and keep the operating part in an operating state.

What is claimed is:

1. An electromagnetic relay comprising a coil block and a contact switching mechanism that are provided on a base plate, a casing that covers these elements, a movable iron piece that is turned by magnetizing and demagnetizing the coil block, and a movable contact piece that is operated to make and break contacts, and wherein an operating part that directly pushes the movable iron piece to turn the same is arranged on an upper surface of the casing and covered by a cover, an operating lever is mounted on the cover to enable sliding operation, and the operating lever can be positioned in a closed position, in which the operating part is covered, a first opened position, in which the operating part is exposed, and a second opened position, in which the operating part is operated, respectively.

2. The electromagnetic relay according to claim 1, wherein positioning of the operating lever is performed by causing an elastic latch part formed on the operating lever to be latched on latch bearing parts formed in three locations on the cover.

3. The electromagnetic relay according to claim 2, wherein the latch bearing parts differ in dimension, over which they are latched on the elastic latch part.

4. The electromagnetic relay according to claim 1, wherein further comprising a light emitting diode that generates light upon magnetization of the coil block, and wherein the operating part is united with a holder body that holds the light emitting diode, through the medium of an elastic arm.

5. The electromagnetic relay according to claim 1, wherein the operating lever comprises falling-off preventive projections that abut against the cover to prevent falling-off when it is operatively slid.

6. The electromagnetic relay according to claim 1, wherein the operating lever comprises, in a separated configuration, an elastic latch part that is latched on and unlatched from respective latch bearing parts, and a push projection that operates the operating part.

7. The electromagnetic relay according to claim 2, wherein further comprising a light emitting diode that generates light upon magnetization of the coil block, and wherein the operating part is united with a holder body that holds the light emitting diode, through the medium of an elastic arm.

8. The electromagnetic relay according to claim 3, wherein further comprising a light emitting diode that generates light upon magnetization of the coil block, and wherein the operating part is united with a holder body that holds the light emitting diode, through the medium of an elastic arm.

9. The electromagnetic relay according to claim 2, wherein the operating lever comprises falling-off preventive projections that abut against the cover to prevent falling-off when it is operatively slid.

10. The electromagnetic relay according to claim 3, wherein the operating lever comprises falling-off preventive projections that abut against the cover to prevent falling-off when it is operatively slid.

11. The electromagnetic relay according to claim 4, wherein the operating lever comprises falling-off preventive projections that abut against the cover to prevent falling-off when it is operatively slid.

12. The electromagnetic relay according to claim 2, wherein the operating lever comprises, in a separated configuration, an elastic latch part that is latched on and unlatched from the respective latch bearing parts, and a push projection that operates the operating part.

13. The electromagnetic relay according to claim 3, wherein the operating lever comprises, in a separated configuration, an elastic latch part that is latched on and unlatched from the respective latch bearing parts, and a push projection that operates the operating part.

14. The electromagnetic relay according to claim 4, wherein the operating lever comprises, in a separated configuration, an elastic latch part that is latched on and unlatched from respective latch bearing parts, and a push projection that operates the operating part.

15. The electromagnetic relay according to claim 5, wherein the operating lever comprises, in a separated configuration, an elastic latch part that is latched on and unlatched from the, respective latch bearing parts, and a push projection that operates the operating part.

* * * * *